US011563288B2

(12) United States Patent
Oosaka et al.

(10) Patent No.: US 11,563,288 B2
(45) Date of Patent: Jan. 24, 2023

(54) ELECTRICAL CONNECTOR ASSEMBLY WITH ELECTROMAGNETIC SHIELDING FRAME SURROUNDING PLURALITY OF TERMINALS AND CONNECTOR HOUSING

(71) Applicant: JAPAN AVIATION ELECTRONICS INDUSTRY, LIMITED, Tokyo (JP)

(72) Inventors: Junji Oosaka, Tokyo (JP); Yohei Yokoyama, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 6 days.

(21) Appl. No.: 17/207,095

(22) Filed: Mar. 19, 2021

(65) Prior Publication Data

US 2021/0359458 A1 Nov. 18, 2021

(30) Foreign Application Priority Data

| | | |
|---|---|---|
| May 13, 2020 | (JP) | JP2020-084468 |
| May 26, 2020 | (JP) | JP2020-091146 |
| Jun. 12, 2020 | (JP) | JP2020-102280 |
| Jun. 18, 2020 | (JP) | JP2020-105098 |
| Jul. 14, 2020 | (JP) | JP2020-120397 |

(Continued)

(51) Int. Cl.

| | |
|---|---|
| ***H01R 13/518*** | (2006.01) |
| ***H01R 13/502*** | (2006.01) |
| ***H01R 13/6581*** | (2011.01) |

(52) U.S. Cl.

CPC ..... *H01R 13/518* (2013.01); *H01R 13/502* (2013.01); *H01R 13/6581* (2013.01)

(58) Field of Classification Search

CPC . H01R 13/518; H01R 13/502; H01R 13/6581

USPC ..... 439/74

See application file for complete search history.

(56) References Cited

U.S. PATENT DOCUMENTS

| | | | | |
|---|---|---|---|---|
| 9,450,340 | B2 * | 9/2016 | Uratani | H01R 13/6585 |
| 10,516,228 | B2 * | 12/2019 | Takenaga | H01R 12/716 |
| 2006/0189183 | A1 * | 8/2006 | Yang | H01R 13/6583 439/95 |

(Continued)

FOREIGN PATENT DOCUMENTS

| | | | | |
|---|---|---|---|---|
| DE | 102015209786 | A1 * | 4/2016 | H01R 13/5202 |
| JP | 2004273277 | A * | 9/2004 | |

(Continued)

OTHER PUBLICATIONS

Office Action dated Nov. 4, 2021 in TW Application No. 110110776, 5 pages.

*Primary Examiner* — Peter G Leigh

(74) *Attorney, Agent, or Firm* — Muncy, Geissler, Olds & Lowe, P.C.

(57) ABSTRACT

Provided is a connector in which a frame is provided with a bending portion while the properties of the frame are maintained. The connector includes a housing to which contacts are attached and a frame which has an end in the first direction fixed to a board and which surrounds the housing. Of the frame, an end portion on a board side in the first direction is provided with a bending portion bent in a second direction, the second direction intersecting the first direction, and a pair of adjacent surfaces adjacent to opposite end surfaces of the bending portion in a third direction, the third direction intersecting each of the first direction and the second direction.

12 Claims, 9 Drawing Sheets

(30) Foreign Application Priority Data

Jul. 16, 2020 (JP) ..... JP2020-121984
Aug. 5, 2020 (JP) ..... JP2020-132981

(56) References Cited

U.S. PATENT DOCUMENTS

2008/0119080 A1* 5/2008 Wu ..... G02B 7/102
439/331
2015/0357729 A1 12/2015 Uratani

FOREIGN PATENT DOCUMENTS

JP 2012252785 A * 12/2012
JP 2016012553 A * 1/2016 ..... H01R 12/716
JP 2017208165 A * 11/2017 ..... H01R 12/71
JP 6269558 B2 * 1/2018 ..... H01R 12/716
JP 6573135 B2 * 9/2019 ..... H01R 12/71

* cited by examiner

FIG. 19
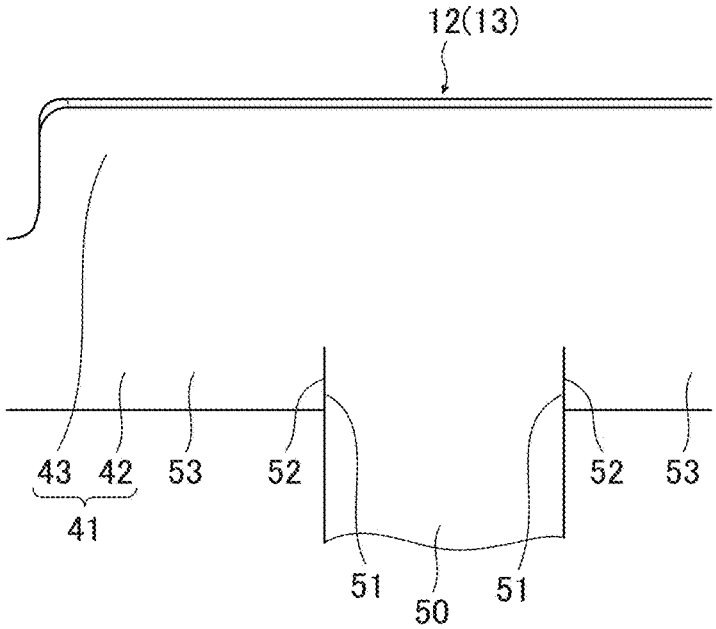
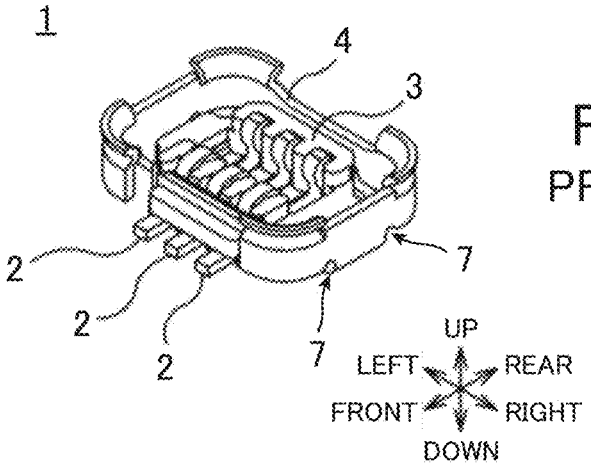
FIG. 20
PRIOR ART
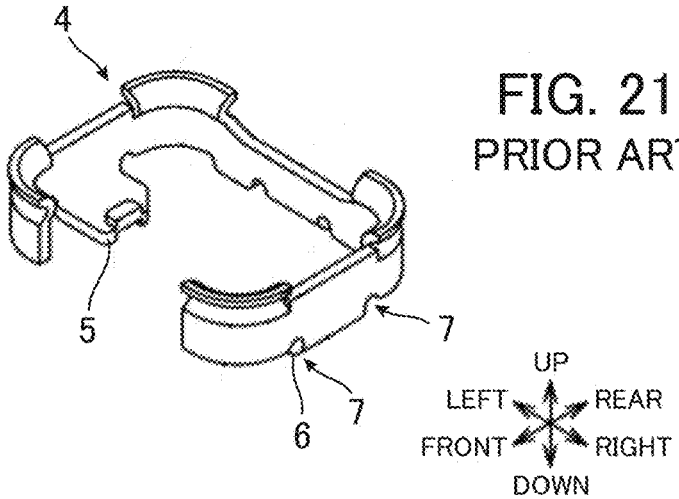
FIG. 21
PRIOR ART

ELECTRICAL CONNECTOR ASSEMBLY WITH ELECTROMAGNETIC SHIELDING FRAME SURROUNDING PLURALITY OF TERMINALS AND CONNECTOR HOUSING

BACKGROUND OF THE INVENTION

The present invention relates to a connector, in particular, to a connector which can be fitted with a counter connector in a first direction and in which a housing that holds contacts is surrounded by a frame.

An example of the connector to be fitted with a counter connector is a connector described in JP 2016-12553A (hereinafter, referred to as "connector 1"). The connector 1 is a receptacle connector and is to be fitted with a counter connector that is a plug connector (not shown) in a vertical direction.

As illustrated in FIG. 20, the connector 1 is configured such that a housing 3 (insulating member) that holds contacts 2 (connection terminals) is surrounded by a substantially rectangular frame 4 (fixed terminal). The frame 4 is fixed to a board (not shown) and is disposed at a position at which the frame 4 faces a side wall surface of the housing 3.

In addition, as illustrated in FIG. 21, protrusions 5 and 6 are provided at a lower portion of the frame 4. The protrusions 5 and 6 are bent toward a side on which the housing 3 is situated (i.e., inner side) when the frame 4 is viewed from an upper position. Tip portions of the protrusions 5 and 6 are each inserted to a predetermined site in the housing 3, whereby the housing 3 is held by the protrusions 5 and 6 of the frame 4.

The above-described frame 4 is provided with cutouts, more specifically, punched holes 7, on opposite sides of each of the protrusions 5 and 6 as shown in FIG. 21. The punched holes 7 are provided to form the protrusions 5 and 6; specifically, the punched holes 7 are holes that are provided in order to form the protrusions 5 and 6 by cutting and bending a sheet metal that constitutes the frame 4. Since the punched holes 7 are provided, it becomes relatively easy to form the protrusions 5 and 6 in the frame 4, that is, the cutting and bending process is facilitated. On the other hand, since through-holes are formed in the frame 4, shielding property or other properties of the frame 4 as well as the strength of the frame 4, for example, may be deteriorated.

SUMMARY OF THE INVENTION

The present invention has been made in view of the above circumstances and is aimed at attaining an object described below. The present invention is to solve the conventional problem above and to provide a connector in which a frame is provided with a bending portion while the properties of the frame are maintained.

In order to attain the above-described object, the connector according to the present invention is a connector which can be fitted with a counter connector in a first direction, the connector comprising a housing to which a contact is attached, and a frame which has an end in the first direction fixed to a board and which surrounds the housing, wherein, of the frame, an end portion on a board side in the first direction is provided with a bending portion bent in a second direction, the second direction intersecting the first direction, and a pair of adjacent surfaces adjacent to opposite end surfaces of the bending portion in a third direction, the third direction intersecting each of the first direction and the second direction.

According to the connector of the present invention configured as above, of the frame, the end portion on the board side in the first direction is provided with the bending portion, and the opposite end surfaces of the bending portion are separately adjacent to surfaces situated on opposite sides of the bending portion (adjacent surfaces). Accordingly, since there is no cutout, e.g., punched hole on opposite sides of the bending portion, the properties of the frame can be prevented from deterioration due to formation of a cutout.

In the connector according to the present invention, it is preferable that the frame is an electromagnetic shielding frame having an electrical potential set to a ground potential. In this case, the effect of the invention would be more significant. In other words, since there is no cutout on opposite sides of the bending portion in the frame, the electromagnetic shielding property of the frame is improved. As a result, the operation of a circuit including the connector is stabilized.

In the connector according to the present invention, an end on the board side in the first direction of the frame may be fixed to the board with solder along an entire periphery of the frame. In this case, since solder is provided along the entire periphery of the frame, minute gaps and the like present in the vicinity of the bending portion of the frame can be filled with solder. As a result, the electromagnetic shielding property of the frame is further improved.

In the connector according to the present invention, the bending portion may be bent toward a side on which the housing is situated in the second direction, and, of the bending portion, an end portion on the side on which the housing is situated in the second direction may be joined to a housing holding portion holding the housing. In this case, the bending portion is needed to unite the housing holding portion with the frame, and the present invention where not a cutout but the bending portion is provided to the frame exhibits the further significance.

In the connector according to the present invention, the contact contains a plurality of contacts, and the contacts may include a high-frequency signal transmitting contact. In this case, since the frame is used as electromagnetic shield in a high-frequency band, the effect of improving the electromagnetic shielding property of the frame becomes further noticeable.

In the present invention, the frame may be divided into two pieces having an identical shape, each of the two pieces may include a pair of walls extending in the second direction and a communication wall extending in the third direction and communicating between the pair of walls, and the two pieces may be arranged so as to oppose to each other while surrounding the housing.

In the present invention, of the frame, the end portion on the board side in the first direction may be provided with a plurality of the bending portions and as many of the pairs of adjacent surfaces as the bending portions. In this case, in the third direction, opposite end surfaces of each of the bending portions are preferably adjacent to a corresponding pair of the adjacent surfaces. With this configuration, even when the frame is provided with a plurality of the bending portions, the properties of the frame may be prevented from deterioration.

In the present invention, each of the pair of adjacent surfaces may be a cut surface formed to provide the bending portion at the end portion on the board side in the first direction of the frame.

In the present invention, it is preferable that the end portion on the board side in the first direction of the frame is provided with a plurality of non-bending portions, in the third direction, the bending portion is disposed so as to be sandwiched between the non-bending portions, and the pair of adjacent surfaces are facing surfaces of two of the non-bending portions sandwiching the bending portion, the facing surfaces each facing the bending portion.

According to the present invention, since it is not required to provide cutouts such as punched holes on opposite sides of a bending portion when the bending portion is provided to a frame (i.e., in cutting and bending process), deterioration in the properties of the frame due to formation of cutouts can be prevented.

BRIEF DESCRIPTION OF THE DRAWINGS

FIG. 19 is a development view of the frame and is an enlarged view of a portion of a sheet metal material constituting the frame, which portion forms the bending portion.

FIG. 20 is a perspective view showing a conventional connector.

FIG. 21 is a perspective view only showing a frame of the conventional connector.

DETAILED DESCRIPTION OF THE INVENTION

A connector according to a specific embodiment of the invention (hereinafter, referred to as "embodiment") is described below with reference to the appended drawings.

The embodiment described below is only an example presented for easy understanding of the invention, and the invention is by no means limited thereto. In other words, the invention may be modified or improved from the embodiment described below without departing from the scope and spirit of the invention. The materials, design dimensions and other factors of components used in the invention can be freely determined depending on the application of the invention, the state of the art at the time when the invention is carried out, and other conditions. Needless to say, the invention includes its equivalents.

In addition, in the following description, three directions intersecting orthogonally to one another are defined as an X direction, a Y direction and a Z direction, and it is assumed that a direction penetrating a board CB described later, i.e., a vertical direction of the connector coincides with the Z direction. It is also assumed that a surface of the board CB on which the connector is mounted is equal to an XY plane, while a lateral width direction (right-left direction) and a front-back direction of the connector are equal to the X direction and the Y direction, respectively.

Furthermore, in the following description, for convenience of the description, a side on which the board CB is situated with respect to the connector when viewed from the Z direction is assumed to be the "lower side," and the opposite side be the "upper side." The upper side of the connector is the "+Z side," and the lower side of the connector the "−Z side."

In this description, meaning of the terms "orthogonal" or "parallel" encompasses an error range generally allowed in the technical field of the connector and includes the cases where a shift within a range of less than a few degrees (e.g., 2 to 3 degrees) with respect to an exact orthogonality or parallel is present.

«Configuration of Connector According to Embodiment»

Figure 5:
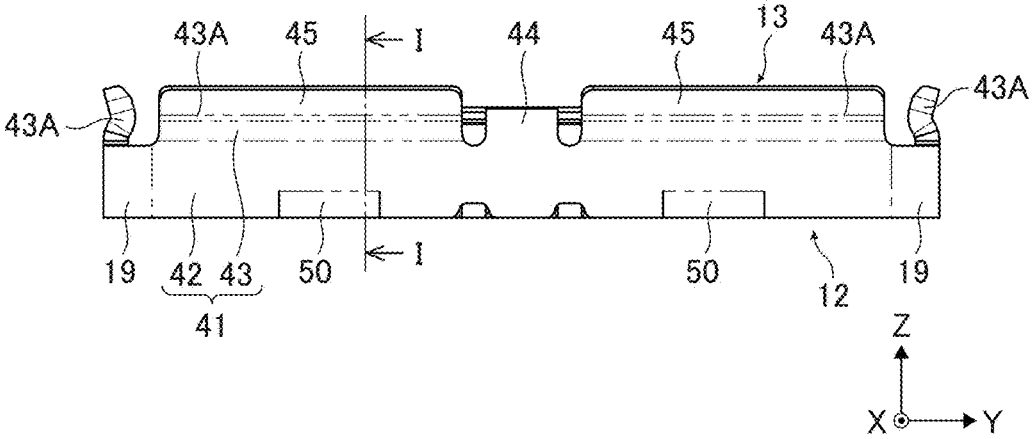
FIG. 5 is a side view of the connector according to the embodiment of the present invention.
Figure 6:
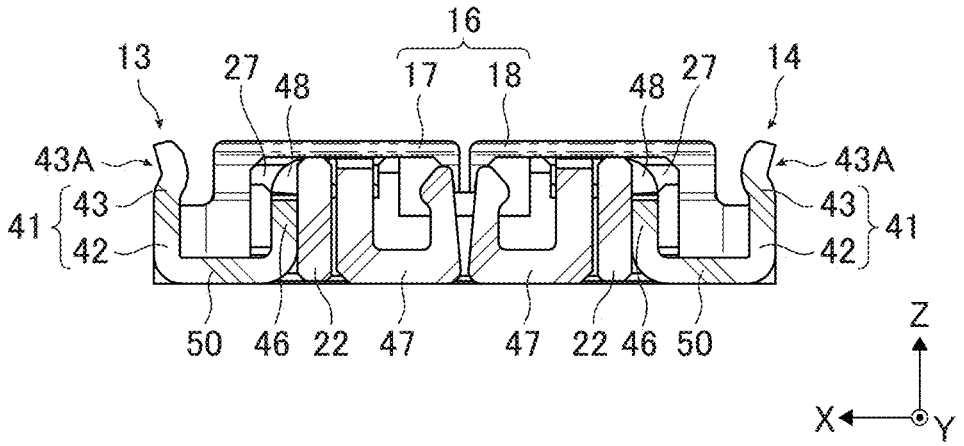
FIG. 6 is a cross-section taken along I-I in FIG. 5.

The configuration of the connector according to the embodiment (hereinafter, referred to as "connector 10") is described with reference to FIGS. 1 to 19. FIG. 6 shows a cross-section taken along I-I in FIG. 5, and the I-I cross-section is a cross-section (XZ plane) passing a position at which a bending portion 50 described later is formed.

Figure 7:
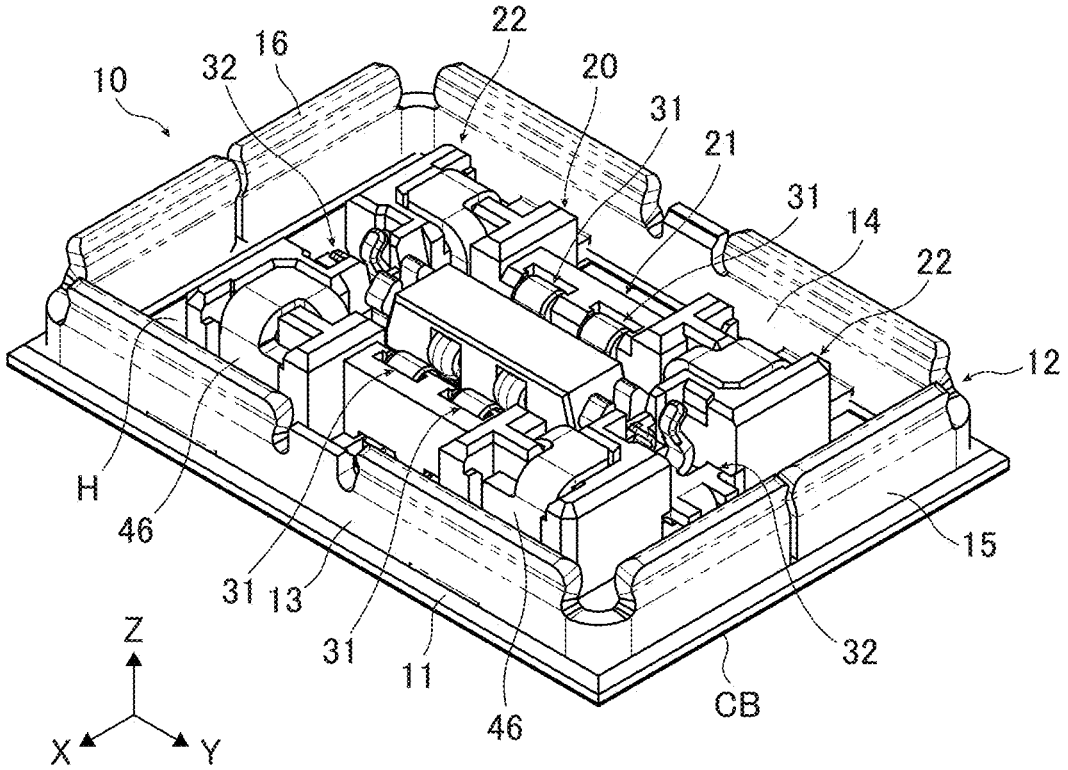
FIG. 7 is a perspective view of the connector mounted on a board.

The connector 10 is a receptacle connector shown in FIGS. 1 to 6 and is fixed to a surface of the board CB with solder 11 and thereby mounted on the board CB as shown in FIG. 7. The connector 10 can be fitted with a counter connector 100 that serves as a plug connector shown in FIG. 8 and, in particular, is fitted with the counter connector 100 in the Z direction as shown in FIG. 9. The Z direction is a fitting direction in which the connector 10 and the counter connector 100 are fitted with each other and corresponds to a "first direction" in the invention.

As shown in FIGS. 1 to 5, the connector 10 includes a frame 12 having a substantially rectangular shape in a plan view, a housing 20 disposed on an inner side of the frame 12 and surrounded by the frame 12, and contacts 31 and 32 attached to the housing 20. The frame 12 and the housing 20 will be described later in detail.

The contact 31 is a low-frequency signal transmitting or power-feeding contact, and a plurality (four in the configuration shown in FIG. 1) of the contacts 31 are fitted in a center portion of the housing 20 in the Y direction (housing center portion 21).

The contact 32 is a high-frequency signal transmitting contact, that is, a radio frequency (RF) terminal, and the contact 32 is press-fitted in each of opposite end portions of the housing 20 in the Y direction (housing end portions 22). Here, for instance, a frequency band of 6 GHz or higher corresponds to the high frequency, and an example thereof is a frequency band including 28 GHz used in the 5th generation (5G) technology.

Figure 1:
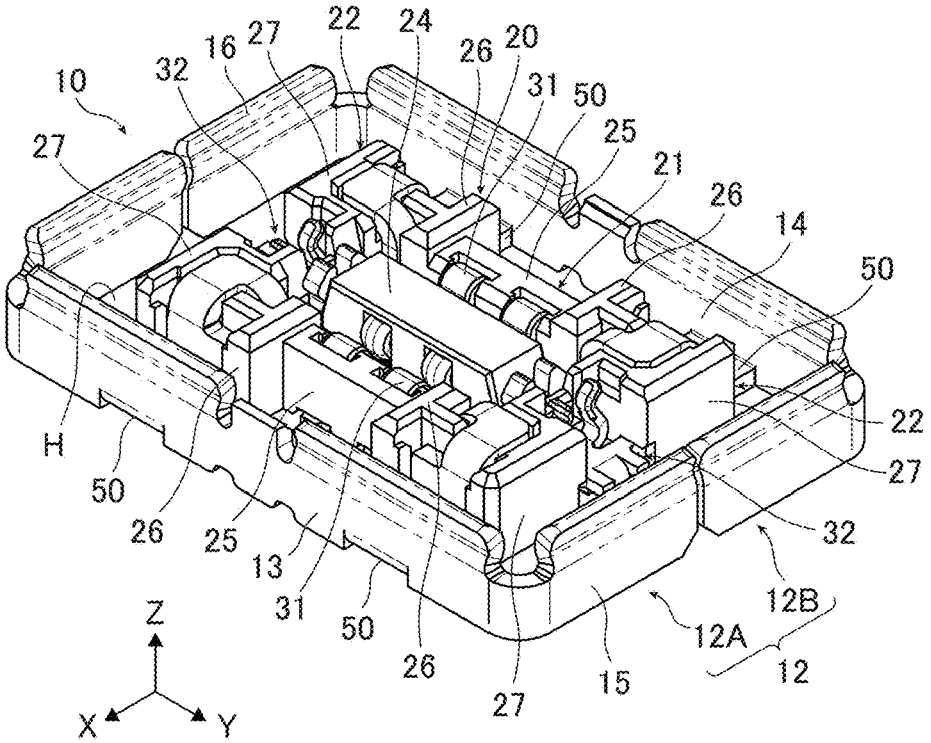
FIG. 1 is a perspective view of a connector according to an embodiment of the present invention.

On the inner side of the frame 12, a recess space H is provided as shown in FIGS. 1 and 7, and in a state where the connector 10 is fitted with the counter connector 100, the whole of the counter connector 100 is accommodated in the recess space H as shown in FIG. 9.

Figure 8:
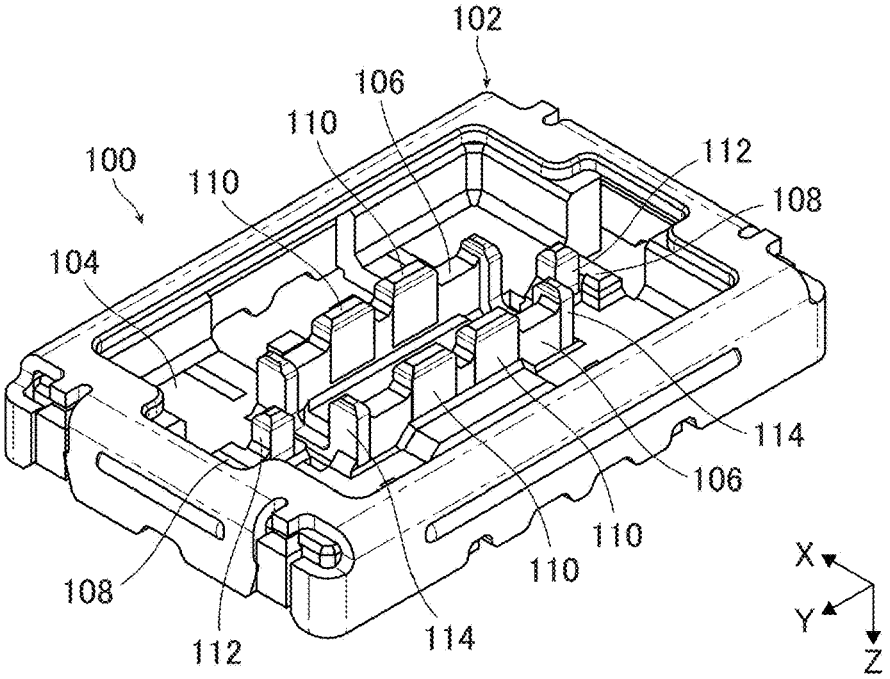
FIG. 8 is a perspective view of a counter connector.
Figure 9:
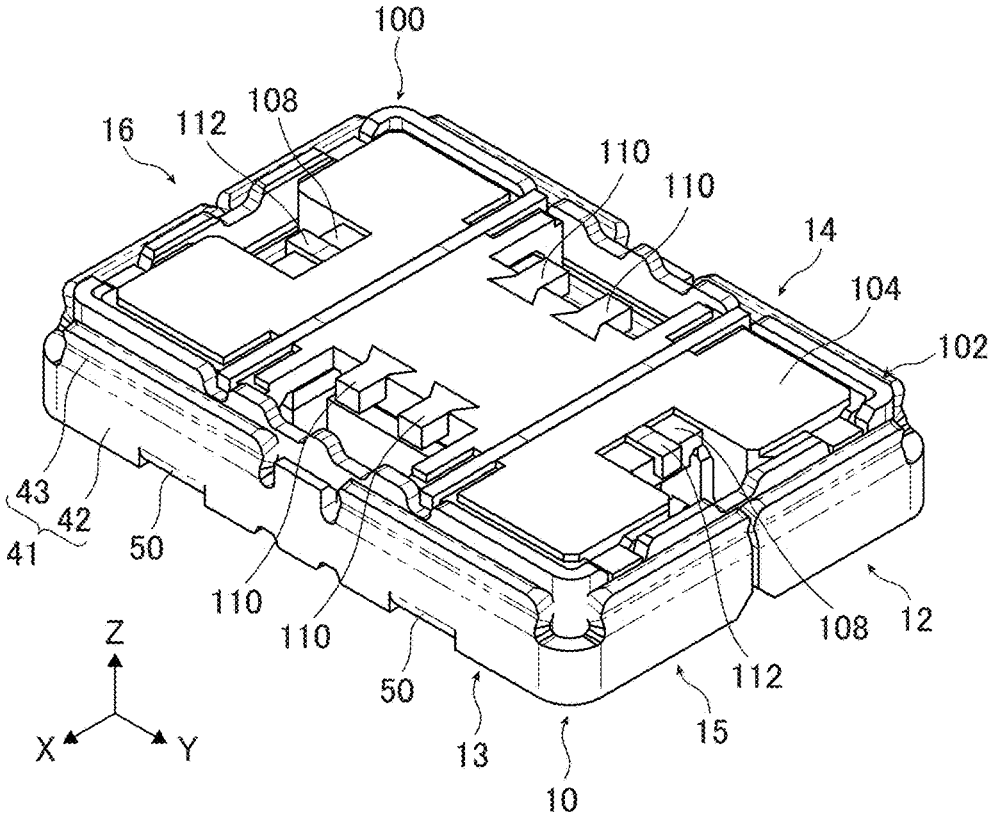
FIG. 9 is a perspective view of the connector fitted with the counter connector.

As shown in FIG. 8, the counter connector 100 includes a counter frame 102 having a substantially rectangular shape in a plan view, a bottom wall 104 on an inner side of the counter frame 102, and contact holding portions 106 and 108 protruding from the bottom wall 104. The contact holding portion 106 is disposed at a Y-directional center portion of the counter connector 100, and as many counter contacts 110 as the number of the contacts 31 are attached to the contact holding portion 106. The contact holding portion 108 is disposed at each of opposite end portions of the counter connector 100 in the Y direction, and a counter contact 112 is attached to each contact holding portion 108.

The counter contacts 110 correspond to the contacts 31 of the connector 10, while the counter contacts 112 correspond to the contacts 32 of the connector 10. In a state where the connector 10 is fitted with the counter connector 100, the contacts 31 and 32 are electrically connected with the corresponding counter contacts 110 and 112, thereby enabling signal transmission between the connectors.

(Housing)

Figure 2:
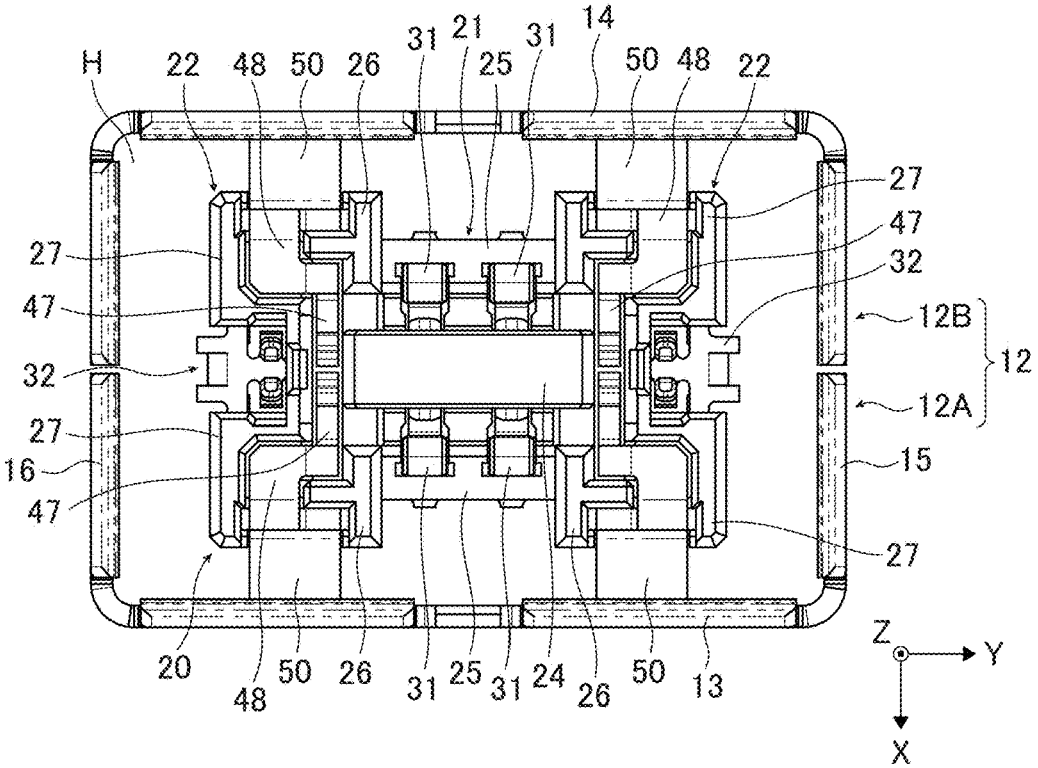
FIG. 2 is a plan view of the connector according to the embodiment of the present invention.
Figure 3:
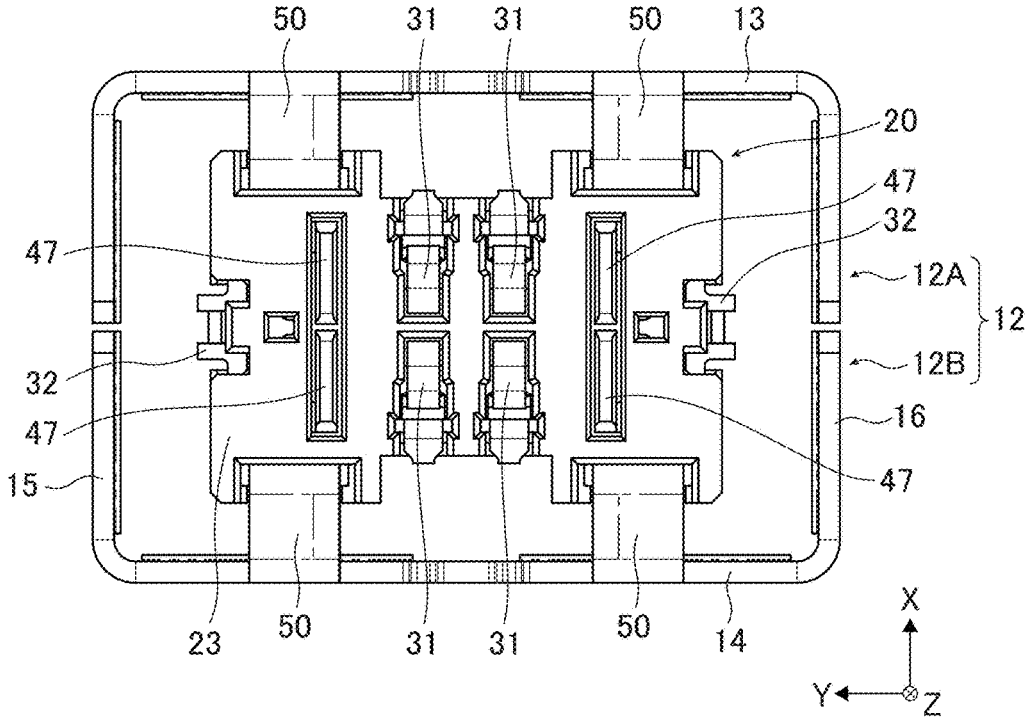
FIG. 3 is a bottom view of the connector according to the embodiment of the present invention.

The housing 20 is an insulator made of insulating resin and is held by the frame 12 (more precisely, a housing holding portion 46 described later) while being disposed in the recess space H as shown in FIG. 1. As shown in FIGS. 1 to 3, the housing 20 includes a housing center portion 21 constituting the Y-directional center portion, housing end portions 22 independently constituting the +Y-directional end portion and the −Y-directional end portion, and a housing bottom portion 23 constituting the −Z-side end portion.

The housing bottom portion 23 continuously extends in the Y direction, and the housing center portion 21 and the two housing end portions 22 each protrude to the +Z side from the housing bottom portion 23.

The housing center portion 21 includes a protrusion portion at the X-directional center portion (center protrusion portion 24) and protrusion portions disposed on opposite sides of the center protrusion portion 24 in the X direction (side protrusion portions 25) as shown in FIGS. 1 and 2. The center protrusion portion 24 and the two side protrusion portions 25 each extend in the Y direction, a recess portion is formed between the center protrusion portion 24 and each of the side protrusion portions 25, and a groove into which the contact 31 is fitted is provided in the recess portion (see FIG. 1).

The housing end portions 22 on the +Y side and the −Y side are configured to be symmetrical with each other; this configuration is described with reference to the housing end portion 22 on the −Y side as an example.

Figure 16:
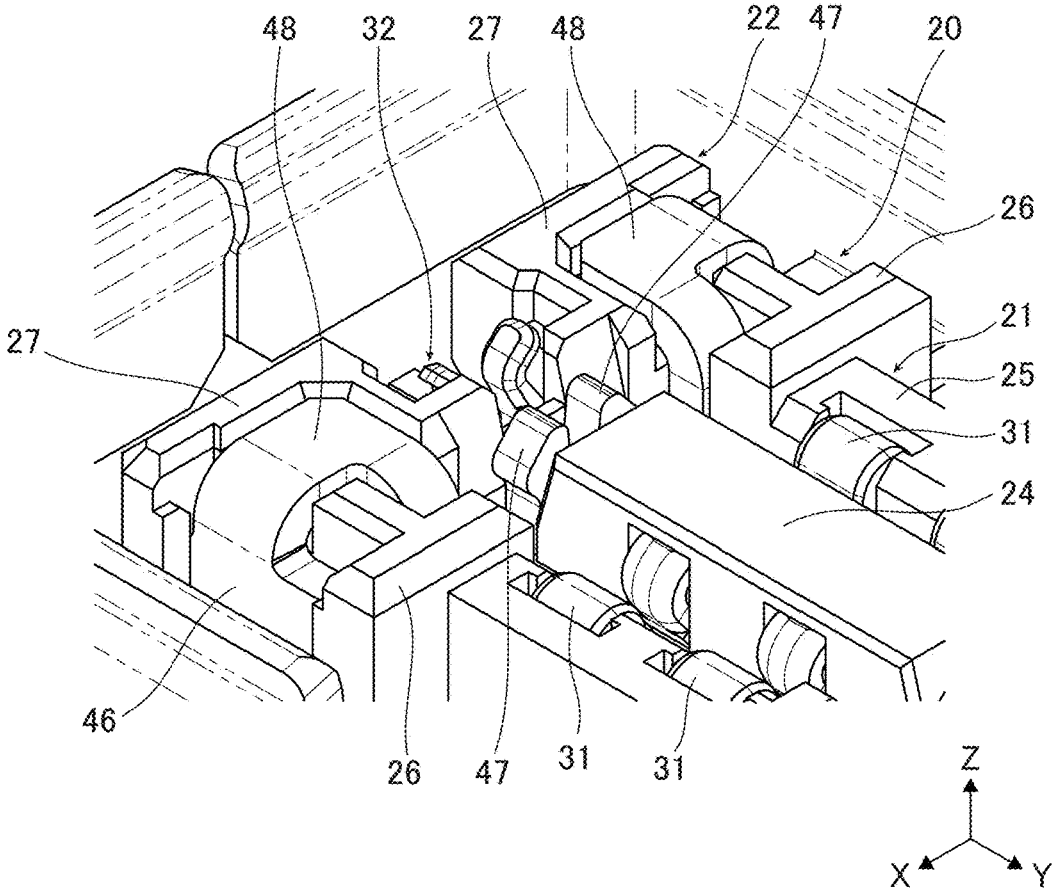
FIG. 16 is an enlarged view of a housing holding portion and a region therearound in FIG. 1.

As shown in FIGS. 1 and 2, the housing end portions 22 are configured so as to be symmetrical with each other with respect to the X-directional center position of the connector 10. Of the housing end portion 22, a portion on the +X side and a portion on the −X side each have an inner protrusion portion 26 and an outer protrusion portion 27 as shown in FIG. 16. The inner protrusion portion 26 is disposed to be continuous with the side protrusion portion 25 of the housing center portion 21 in the Y direction, and the outer protrusion portion 27 is disposed to be aligned with the inner protrusion portion 26 on the outer side of the inner protrusion portion 26 in the Y direction.

In the housing end portion 22, the contact 32 is pressed to an inner side in the X direction of a gap between the outer protrusion portion 27 on the +X side and the outer protrusion portion 27 on the −X side and is fitted in the gap (see FIG. 2). In addition, in the housing end portion 22, the housing holding portion 46 is inserted in a recess portion formed between the inner protrusion portion 26 and the outer protrusion portion 27 (see FIG. 16).

(Frame)

Figure 10:
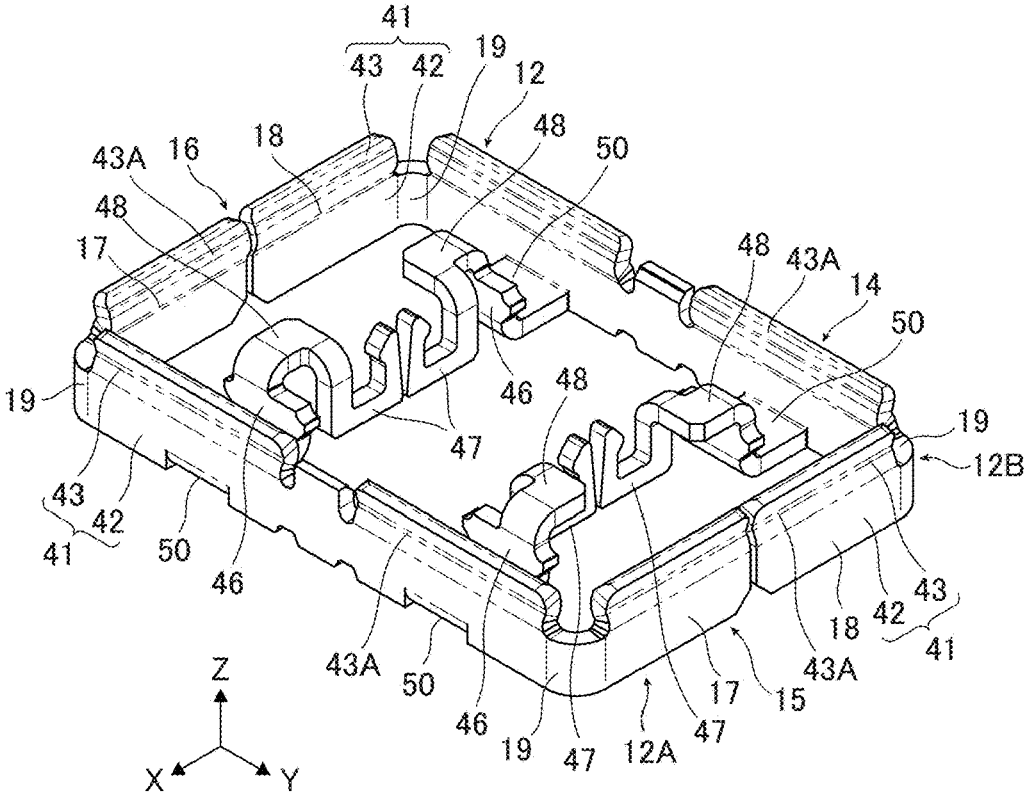
FIG. 10 is a perspective view of a frame of the connector according to the embodiment of the present invention.
Figure 11:
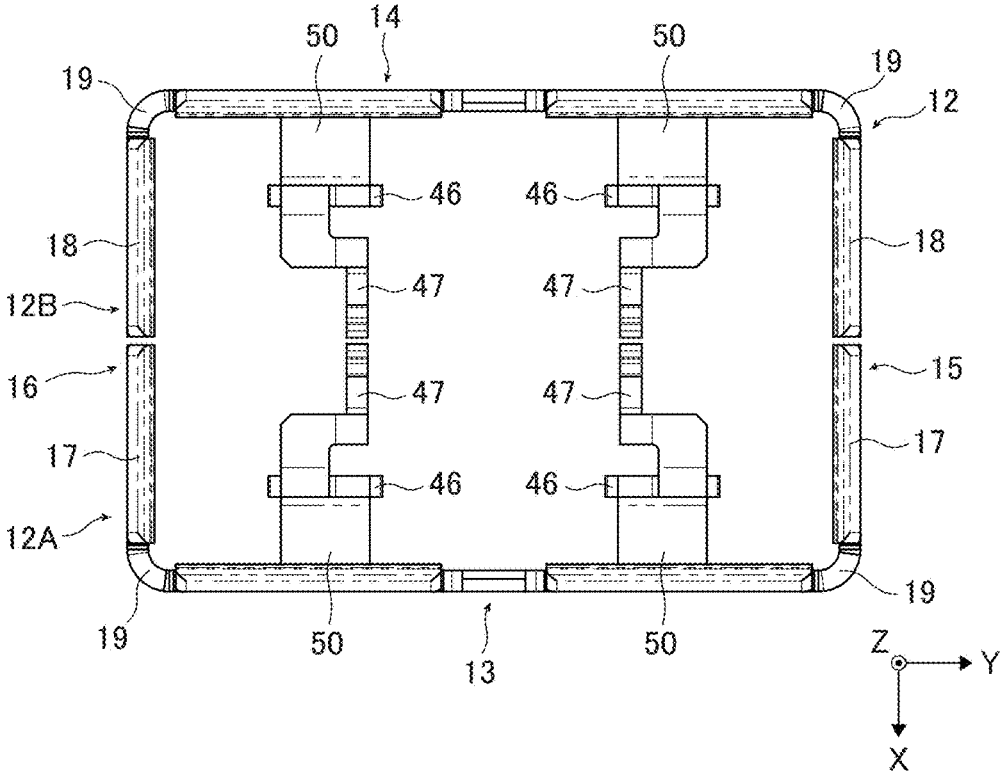
FIG. 11 is a plan view of the frame of the connector according to the embodiment of the present invention.
Figure 12:
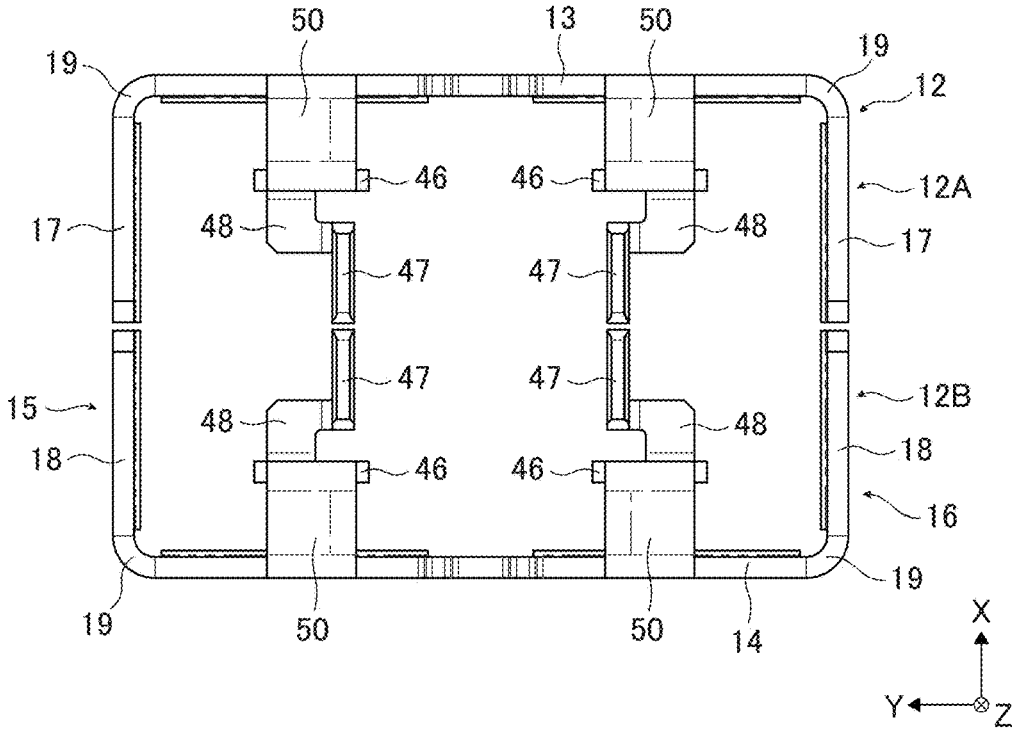
FIG. 12 is a bottom view of the frame of the connector according to the embodiment of the present invention.

The frame 12 is a frame having a substantially rectangular shape in a plan view as shown in FIGS. 10 to 12 and surrounds the housing 20 in the X and Y directions. The frame 12 is formed of a metal sheet, for example, a sheet material made of a copper alloy such as brass and bronze or stainless steel. The sheet thickness of the metal sheet to form the frame 12 is set to 0.06 mm to 0.15 mm, for example.

The lower end (−Z side end) of the frame 12 is fixed to the board CB with the solder 11. The solder 11 is provided along the entire periphery of the frame 12 as shown in FIG. 7. That is, the lower end (end on the board CB side in the Z direction) of the frame 12 is fixed to the board CB with the solder 11 over the entire periphery of the frame 12.

The frame 12 according to the embodiment is an electromagnetic shielding frame (shell) having an electrical potential set to the ground potential. More specifically, a grounding conductive pattern (not shown) formed in conformity with the outer shape of the frame 12 is provided on the top surface (+Z side surface) of the board CB, and the frame 12 is fixed to the board CB while being placed on the conductive pattern.

As described above, the lower end of the frame 12 is fixed to the board CB with solder along the entire periphery of the frame 12, and a gap between the frame 12 and the board CB is filled with the solder 11 along the entire periphery of the frame 12. The solder 11 also fills even a minute gap between a portion of the frame 12, which portion is bent to form a bending portion 50 described later (in particular, a portion between a pair of adjacent surfaces 52 described later), and the board CB. Such configuration suppresses entrance and emission of electromagnetic waves through the gap between the frame 12 and the board CB, whereby the frame 12 has excellent electromagnetic shielding property.

Figure 4:
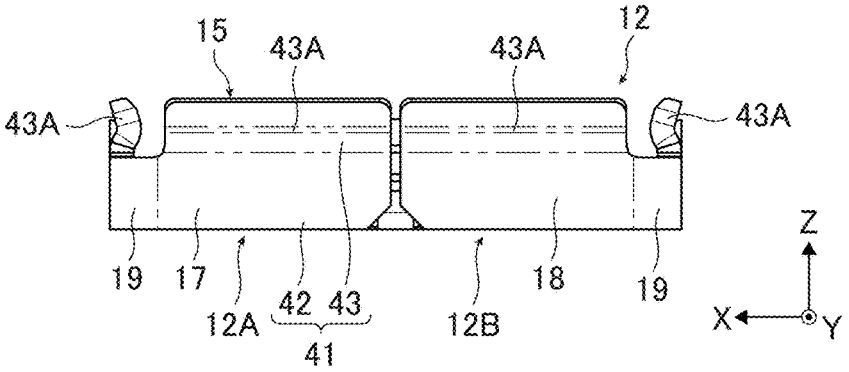
FIG. 4 is a front view of the connector according to the embodiment of the present invention.

As shown in FIGS. 10 to 14, the frame 12 includes a pair of long side walls 13 and 14 aligned in the X direction and a pair of short side walls 15 and 16 aligned in the Y direction. The long side wall 13 or 14 and the short side wall 15 or 16 intersect each other, precisely, intersect orthogonally to each other. The frame 12 includes a plurality of (in particular, four) corners 19, and the long side walls 13 and 14 are jointed to the short side walls 15 and 16 at the respective corners 19. Each corner 19 may be rounded as shown in FIGS. 3 and 4 or bent at a substantially right angle to form L-shape.

The pair of long side walls 13 and 14 are arranged in parallel with each other, extend long in the Y direction, and are configured to be symmetrical with each other with respect to the X-directional center position of the connector 10. A direction penetrating the long side walls 13 and 14, i.e., the X direction, corresponds to a second direction in the invention and intersects, more specifically intersects orthogonally to the first direction, i.e., the Z direction. In addition, a direction in which the long side walls 13 and 14 extend, i.e., the Y direction, corresponds to a third direction in the invention and intersects, more specifically intersects orthogonally to each of the X direction and the Z direction.

The pair of short side walls 15 and 16 are arranged in parallel with each other, extend in the X direction, and are configured to be symmetrical with each other with respect to the Y-directional center position of the connector 10. Each of the short side walls 15 and 16 is divided at the X-directional center position of the connector 10 into two walls 17 and 18 as shown in FIGS. 2 and 4. The two walls 17 and 18 extend in the X direction and are configured to be symmetrical with each other with respect to the X-directional center position of the connector 10.

Figure 13:
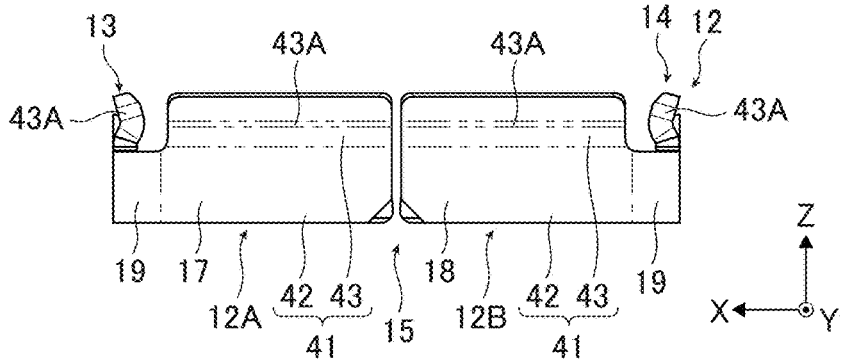
FIG. 13 is a front view of the frame of the connector according to the embodiment of the present invention.

The two walls 17 and 18 are aligned linearly in the X direction while being apart from each other by a small distance as shown in FIG. 13. In other words, the frame 12 is divided into two pieces 12A and 12B in the X direction as shown in FIGS. 10 to 12, the pieces having an identical shape to each other. The two pieces 12A and 12B are symmetrical, specifically, have a mirror image relationship with each other with respect to the X-directional center position of the connector 10. In addition, as shown in FIGS. 1 and 2, the two pieces 12A and 12B are arranged to oppose to each other while surrounding the housing 20.

Figure 15:
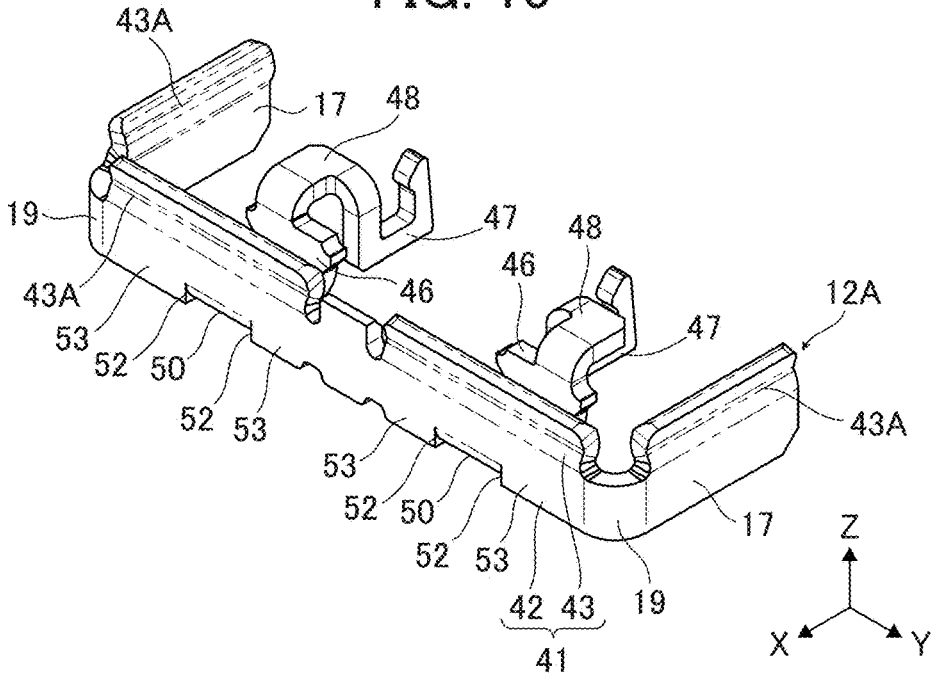
FIG. 15 is a perspective view showing a piece constituting a half of the frame of the connector according to the embodiment of the present invention.

Below, the configuration of the two pieces 12A and 12B in a mirror image relationship with each other will be described with reference to the piece 12A on the +X side shown in FIG. 15 (hereinafter, simply referred to as "piece 12A"). The piece 12A is made of a metal sheet and includes a long side wall 13 on the +X side and a pair of walls 17 disposed on opposite sides of the long side wall 13 as shown in FIG. 15. The pair of walls 17 correspond to the +X side walls 17 separately included in the short side wall 15 on the +Y side and the short side wall 16 on the −Y side and extend in the X direction (second direction). The long side wall 13 extends in the Y direction (third direction) and interconnects the outer ends in the X direction of the pair of walls 17. In other words, the long side wall 13 corresponds to a communication wall communicating between the pair of walls 17.

Figure 14:
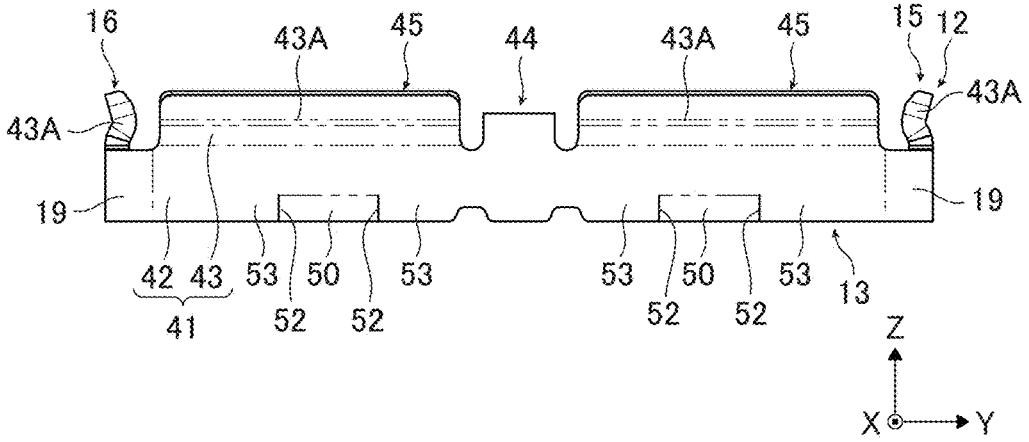
FIG. 14 is a side view of the frame of the connector according to the embodiment of the present invention.

The long side wall 13 and the pair of walls 17 each include a wall body 41 as shown in FIGS. 10 to 15. The wall body 41 of the long side wall 13 rises from the board CB to the +Z side and extends along the Y direction. The wall body 41 of each of the pair of walls 17 rises from the board CB to the +Z side and extends along the X direction. As shown in FIGS. 13 to 15, each wall body 41 includes a lower portion 42 situated on the board CB side (−Z side) and an upper portion 43 extending from the lower portion 42 further to the +Z side.

The lower portion 42 corresponds to an end portion of the frame 12 on the board CB side in the Z direction and continuously extends in the Y direction, and the lower end of the lower portion 42 is in contact with the board CB.

The upper portion 43 has its upper end curved in a substantially V shape so as to extend to the outer side (opposite side from the side on which the housing 20 is situated) as shown in FIGS. 13 to 15. In other words, the upper portion 43 has a curved portion 43A of substantially V shape at an intermediate position in the Z direction.

As shown in FIG. 14, the upper portion 43 of the wall body 41 constituting the long side wall 13 is divided into multiple portions in the Y direction, specifically, into a center portion 44 and side portions 45 separately situated on the +Y side and the −Y side of the center portion 44. Of these, the side portions 45 are each provided with the foregoing curved portion 43A.

Since the above curved portion 43A is provided at the upper portion 43 of the wall body 41, the counter connector 100 is easily led into the recess space H of the connector 10 in the process of fitting the connectors. In addition, since the above curved portion 43A is provided, the contact between the frame 12 of the connector 10 and a frame (counter frame 102) of the counter connector 100 is stabilized in the fitting state of the connectors.

The configuration of the wall body 41 of the long side wall 13 will be described more specifically. The lower portion 42 of the wall body 41 constituting the long side wall 13 is provided with a plurality of (two in the case of the drawing) bending portions 50 as shown in FIGS. 10 to 12 and 15. The bending portion 50 is a portion bent toward the side on which the housing 20 is situated in the X direction, i.e., toward the inner side, and has a cross section (section orthogonal to the Y direction) in a substantially L shape as shown in FIG. 6. The bending portion 50 has a certain width in the Y direction as shown in FIGS. 11 and 12 and extends straight in the X direction. The bending portion 50 may be bent at a substantially right angle into a substantially L shape as shown in FIG. 6 or may be rounded (into an arc-like shape).

The bending portion 50 is provided to unite the housing holding portion 46 holding the housing 20 with the frame 12. Specifically, the housing holding portion 46 is joined to the inner end in the X direction (i.e., end on the side on which the housing 20 is situated) of the bending portion 50 as shown in FIGS. 10 to 11.

The housing holding portion 46 rises from the inner end in the X direction of the bending portion 50 to the +Z side, and the opposite ends in the Y direction of the housing holding portion 46 are each formed in a tapered shape tapering toward the Y directional end. In the embodiment, the housing holding portion 46 is continuous with the bending portion 50, in other words, is united with the frame 12 and formed of part of a metal sheet constituting the frame 12.

A brief procedure of assembling the housing 20 to the frame 12 will be described. The frame 12 before assembling is brought in the vicinity of the housing 20 from an upper position over the housing 20, and the housing 20 enters inside the frame 12, i.e., the recess space H. In this process, the housing holding portion 46 is inserted in the recess portion formed between the inner protrusion portion 26 and the outer protrusion portion 27 in the housing end portion 22. Subsequently, the opposite end portions in the Y direction of the housing holding portion 46 independently bite into the Y directional outer wall surface of the inner protrusion portion 26 and the Y directional inner wall surface of the outer protrusion portion 27, whereby the housing holding portion 46 is assembled to (engaged with) the inner protrusion portion 26 and the outer protrusion portion 27.

In the embodiment, the bending portion 50 is provided with, in addition to the housing holding portion 46, a shield portion 47 as a countermeasure to crosstalk occurrence. In a state where the connector 10 and the counter connector 100 are fitted with each other, the shield portion 47 together with a counter shield portion 114 provided to the counter connector 100 constitutes a shield wall against crosstalk occurrence (not shown). The shield wall can suppress crosstalk of signals (specifically, high-frequency signals) between the contact 32 on the +Y side and the contact 32 on the −Y side. As shown in FIG. 15, the shield portion 47 is joined to the housing holding portion 46 through a joint portion 48 extending from the upper end (+Z side end) of the housing holding portion 46 and is assembled to the bending portion 50 through the housing holding portion 46 and the joint portion 48.

Meanwhile, in a case where the bending portion 50 is provided at a lower end portion of the frame 12 (i.e., the lower portion 42 of the wall body 41), typically, cutouts such as punched holes are formed in a base material of the frame 12 at positions corresponding to the opposite sides of the bending portion 50 as shown in FIG. 21. In addition, of the base material of the frame 12, a portion situated between the cutouts is bent (i.e., subjected to lancing process). In the meantime, when cutouts such as punched holes are formed at a lower portion of the frame 12, electromagnetic waves enter or are emitted through the cutouts, and hence the electromagnetic shielding property of the frame 12 may be impaired. Moreover, the strength of the frame 12 may be deteriorated due to formation of the cutouts.

Figure 17:
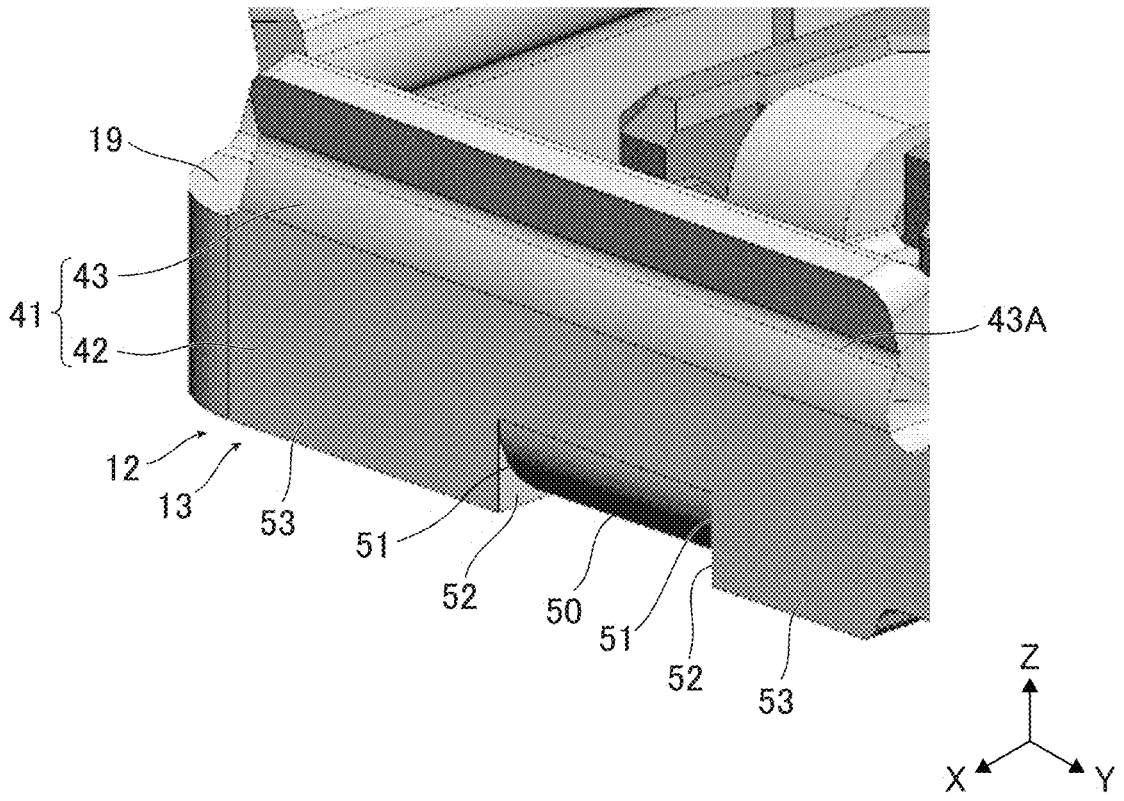
FIG. 17 is an enlarged perspective view of a bending portion.
Figure 18:
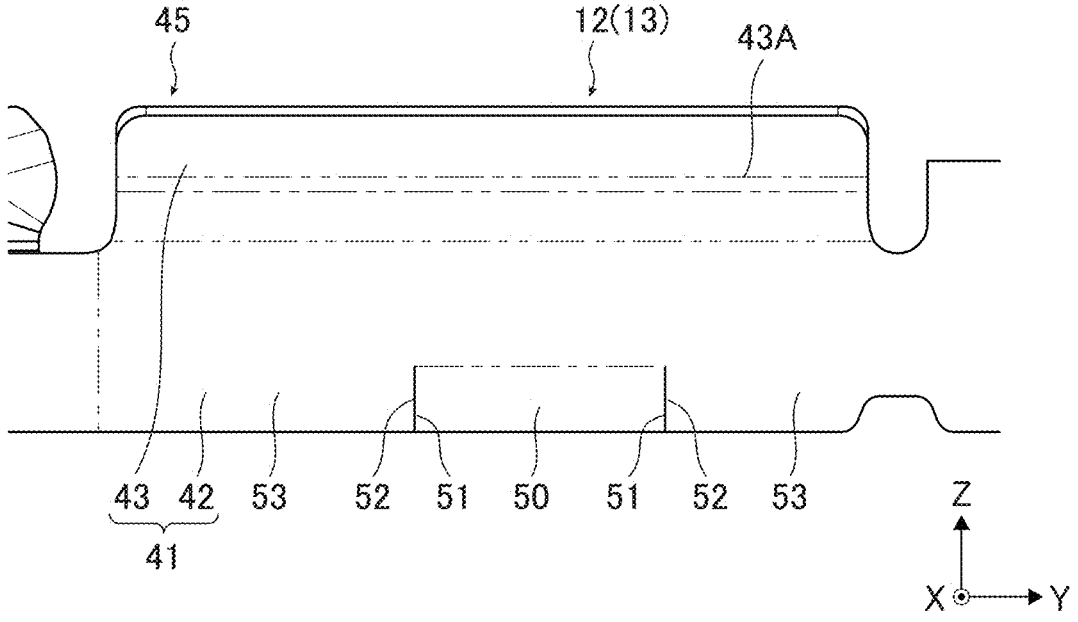
FIG. 18 is an enlarged view of the bending portion and a region therearound in FIG. 14.

On the contrary, no cutout is formed on opposite sides of the bending portion 50 in the embodiment; opposite end surfaces 51 in the Y direction of the bending portion 50 are separately adjacent to the pair of adjacent surfaces 52 as shown in FIGS. 17 and 18.

More specifically, the lower portion 42 of the wall body 41 constituting the long side wall 13 is provided with a plurality of non-bending portions 53 as shown in FIG. 18. Each non-bending portion 53 constitutes part of the lower portion 42 of the wall body 41, which part is adjacent to the bending portion 50 in the Y direction. In the Y direction, the bending portion 50 (more precisely, a root part of the bending portion 50) is disposed so as to be sandwiched between two non-bending portions 53. The pair of adjacent surfaces 52 constitute facing surfaces facing the bending portion 50 and are independently provided to the two non-bending portions 53 sandwiching the bending portion 50.

To be more specific, when the wall body 41 is expanded (for easier understanding, before the part to form the bending portion 50 is bent), as shown in FIG. 19, the part to form the bending portion 50 and the parts to form the non-bending portions 53 are aligned continuously in the Y direction. In addition, at boundary positions between the part to form the bending portion 50 and the parts to form the non-bending portions 53, the lower portion 42 of the wall body 41 is cut in the Z direction.

Of the lower portion 42 of the wall body 41, the part situated between the cutting positions is then bent (subjected to lancing process), whereby the bending portion 50 is formed at the lower portion 42, and on opposite sides of the bending portion 50, the pair of adjacent surfaces 52 separately adjacent to opposite end surfaces 51 of the bending portion 50 are provided. In other words, it may be said that each of the pair of adjacent surfaces 52 is a cut surface formed to provide the bending portion 50 at the lower portion 42.

In the embodiment, as shown in FIGS. 10 to 12 and 14, the lower portion 42 of the wall body 41 constituting the long side wall 13 is provided with a plurality of bending portions 50 such that the bending portions 50 are disposed in a symmetrical manner with respect to the Y directional center position of the connector 10. The lower portion 42 is provided with as many pairs of adjacent surfaces 52 as the number of the bending portions 50. In the Y direction, the opposite end surfaces 51 of each of the bending portions 50 are adjacent to the corresponding pair of adjacent surfaces 52. The pair of adjacent surfaces 52 corresponding to the bending portion 50 are separately provided at the two non-bending portions 53 sandwiching the corresponding bending portion 50 and thus are the facing surfaces facing the corresponding bending portion 50.

As described above, there is no gap (cutout) between the bending portion 50 and the two non-bending portions 53 sandwiching the bending portion 50 in the embodiment. In other words, in the Y direction, a distance between the two non-bending portions 53 substantially coincides with a width (Y directional length) of the bending portion 50. Since there is no cutout at opposite sides of the bending portion 50 in the frame 12 as above, the foregoing problem can be solved. That is, entrance and emission of electromagnetic waves through cutouts can be prevented, the electromagnetic shielding property of the frame 12 is improved, and, as a result, the operation of an entire circuit including the connector 10 is stabilized.

In the embodiment, the contacts provided to the connector 10 include the high-frequency signal transmitting contact 32. Hence, the effect of improving the electromagnetic shielding property of the frame 12 owing to omission of cutouts at opposite sides of the bending portion 50 in the frame 12 is exhibited also in a high-frequency band.

While the opposite end surfaces 51 of the bending portion 50 and the pair of adjacent surfaces 52 are adjacent to each other as described above, more precisely, the opposite end surfaces 51 of the root part of the bending portion 50 are adjacent to the pair of adjacent surfaces 52. Of the bending portion 50, other part than the root part (e.g., part extending toward the X directional inner side) may have its opposite end surfaces apart from the pair of adjacent surfaces 52 in the X direction (second direction).

OTHER EMBODIMENTS

While the connector of the invention has been described above with reference to a specific example, the foregoing embodiment is mere an example used to facilitate the understanding of the invention, and there may be other embodiments. For example, while the long side walls 13 and 14 of the frame 12 are provided with a plurality of (two in the case of the drawing) bending portions 50 in the foregoing embodiment, the number of the bending portions 50 is not particularly limited as long as at least one thereof is provided.

In addition, the invention is not limited to the configuration where the bending portions 50 are provided to the long side walls 13 and 14, and the short side walls 15 and 16 may be provided with the bending portions 50. In this case, a direction penetrating the short side walls 15 and 16 (i.e., Y direction) would be the second direction, and a direction in which the short side walls 15 and 16 extends (i.e., X direction) the third direction.

In addition, the outer shape of the frame 12 is a rectangular shape elongated in the Y direction in the foregoing embodiment, but the invention is not limited thereto. The outer shape of the frame may be a circular shape, another quadrilateral shape than a rectangular shape such as a trapezoidal shape or a rhomboid shape, or a polygonal shape other than a rectangular shape. In addition, the frame 12 is an electromagnetic shielding frame in the foregoing embodiment, but the invention is not limited thereto. The invention is also applicable to a frame with no electromagnetic shielding property (for example, a frame which functions as a protection frame for protecting a housing and a contact).

In the foregoing embodiment, the contacts 31 and 32 include the high-frequency signal transmitting contact 32, but the invention is not limited thereto. That is, the contacts may include only those for transmitting signals in a general frequency band or in a low frequency band.

In the foregoing embodiment, the frame 12 has a configuration in which the frame is divided into the two pieces 12A and 12B having an identical shape, but the invention is not limited thereto. For instance, the frame may be consisted of a single continuous body (specifically, a frame body that is inseparable).

What is claimed is:

1. A connector configured to be fitted with a counter connector in a first direction, comprising:

a housing to which a contact is attached; and a frame having an end in the first direction fixed to a board and surrounding the housing, wherein, of the frame, an end portion on a board side in the first direction is provided with:

a bending portion bent in a second direction, the second direction intersecting the first direction; and a pair of adjacent surfaces adjacent to opposite end surfaces of the bending portion in a third direction, the third direction intersecting each of the first direction and the second direction, and wherein each of the pair of adjacent surfaces is a cut surface formed to provide the bending portion at the end portion on the board side in the first direction of the frame.

2. The connector according to claim 1, wherein the frame is an electromagnetic shielding frame having an electrical potential set to a ground potential.

3. The connector according to claim 2, wherein the bending portion is bent toward a side on which the housing is situated in the second direction, and wherein, of the bending portion, an end portion on the side on which the housing is situated in the second direction is joined to a housing holding portion holding the housing.

4. The connector according to claim 1, wherein the end on the board side in the first direction of the frame is fixed to the board with solder along an entire periphery of the frame.

5. The connector according to claim 4, wherein the bending portion is bent toward a side on which the housing is situated in the second direction, and wherein, of the bending portion, an end portion on the side on which the housing is situated in the second direction is joined to a housing holding portion holding the housing.

6. The connector according to claim 1, wherein the bending portion is bent toward a side on which the housing is situated in the second direction, and wherein, of the bending portion, an end portion on the side on which the housing is situated in the second direction is joined to a housing holding portion holding the housing.

7. The connector according to claim 1, wherein the contact contains a plurality of contacts, and the contacts include a high-frequency signal transmitting contact.

8. The connector according to claim 1, wherein the frame is divided into two pieces having an identical shape, wherein each of the two pieces includes: a pair of walls extending in the second direction; and a communication wall extending in the third direction and communicating between the pair of walls, and wherein the two pieces are arranged so as to oppose to each other while surrounding the housing.

9. The connector according to claim 1, wherein, of the frame, the end portion on the board side in the first direction is provided with a plurality of the bending portions and as many of pairs of adjacent surfaces as the bending portions, and wherein, in the third direction, opposite end surfaces of each of the bending portions are adjacent to a corresponding pair of the adjacent surfaces.

10. The connector according to claim 1, wherein the end portion on the board side in the first direction of the frame is provided with a plurality of non-bending portions, wherein, in the third direction, the bending portion is disposed so as to be sandwiched between the non-bending portions, wherein the pair of adjacent surfaces face surfaces of two of the non-bending portions sandwiching the bending portion, and each of the facing surfaces faces the bending portion.

11. A connector configured to be fitted with a counter connector in a first direction, comprising:

a housing to which a contact is attached; and a frame having an end in the first direction fixed to a board, and surrounding the housing, wherein, of the frame, an end portion on a board side in the first direction is provided with:

a bending portion bent in a second direction, the second direction intersecting the first direction; and a pair of adjacent surfaces adjacent to opposite end surfaces of the bending portion in a third direction, the third direction intersecting each of the first direction and the second direction, wherein, of the frame, the end portion on the board side in the first direction is provided with a plurality of the bending portions and as many of the pairs of adjacent surfaces as the bending portions, and wherein, in the third direction, opposite end surfaces of each of the bending portions are adjacent to a corresponding pair of the adjacent surfaces.

12. A connector configured to be fitted with a counter connector in a first direction, comprising:

a housing to which a contact is attached; and a frame having an end in the first direction fixed to a board, and surrounding the housing, wherein, of the frame, an end portion on a board side in the first direction is provided with:

a bending portion bent in a second direction, the second direction intersecting the first direction; and a pair of adjacent surfaces adjacent to opposite end surfaces of the bending portion in a third direction, the third direction intersecting each of the first direction and the second direction, wherein the end portion on the board side in the first direction of the frame is provided with a plurality of non-bending portions, wherein, in the third direction, the bending portion is disposed so as to be sandwiched between the non-bending portions, wherein the pair of adjacent surfaces face surfaces of two of the non-bending portions sandwiching the bending portion, and each of the facing surfaces face the bending portion.

* * * * *